United States Patent [19]

Welten

[11] 4,010,861

[45] Mar. 8, 1977

[54] NURSING BOTTLE

[76] Inventor: Ottar Torolf Welten, Brandshaug, N-2340 Loten, Norway

[22] Filed: Oct. 1, 1975

[21] Appl. No.: 612,469

[52] U.S. Cl. ..... 215/11 B

[51] Int. Cl.[2] ..... A61J 9/04

[58] Field of Search ..... 215/11 R, 11 B, 11 D; 222/212

[56] References Cited

UNITED STATES PATENTS

| | | | |
|---|---|---|---|
| 2,898,007 | 8/1959 | Gassaway | 222/212 |
| 2,907,485 | 10/1959 | Lunden | 215/11 R |
| 3,043,462 | 7/1962 | Brill | 215/11 R |
| 3,134,495 | 5/1964 | Carbonel | 215/11 B |
| 3,162,318 | 12/1964 | Woodbury | 215/11 R |
| 3,184,120 | 5/1965 | Undi | 215/11 R |
| 3,200,980 | 8/1965 | Jamell | 215/11 B |

FOREIGN PATENTS OR APPLICATIONS

| | | | |
|---|---|---|---|
| 439,585 | 12/1967 | Switzerland | 215/11 R |

*Primary Examiner*—Donald F. Norton
*Attorney, Agent, or Firm*—John J. Dennemeyer

[57] ABSTRACT

A nursing bottle consisting of a cylindrical tube of transparent material has slightly enlarged end portions on which a suction nipple is secured at one enlarged end by means of a threaded cap and a one-way valve is secured by means of a similar cap at the other end. A slidable piston is designed and arranged inside the tube so as to move toward the nipple end of the bottle as the liquid in the bottle decreases.

5 Claims, 6 Drawing Figures

6b
5
2
1
12
6a
7

4
2
3

4

8
9
10
11

9
11

16
14
19
17
13
18
15

NURSING BOTTLE

The general purpose of the present invention is to provide a combination of a nursing bottle and a comforter dummy, or pacifier, for babies.

It is already known to separately use nursing bottles and comforter dummies, or pacifiers, for babies. Three disadvantages are especially pronounced in the use of nursing bottles. In order to allow the baby to suck out the milk from a nursing bottle which, aside from the suction openings at the top of the nipple, is completely tight, air must be admitted into the bottle through these openings as the baby sucks out the milk. This air together with the milk is sucked into the stomach of the baby and causes often serious stomach aches. If the baby is sucking the nipple too long without admitting air into the bottle, a negative pressure will arise therein and the nipple will be flatly pressed against the bottle so that further milk cannot be sucked out. The mother of the baby must remove the nipple and again mount it in place. Another inconvenience is that the baby will spit out the nipple and bottle when it does not want any more milk. If the nursing bottle still contains a quantity of milk this often will be poured out over the bed.

From Swiss Pat. No. 439,585 it is known to use a piston mounted in a nursing bottle and adapted to be sucked upwardly in the bottle together with the milk on the top side thereof since an opening is provided in the bottom of the bottle. A disadvantage of this construction is that the piston, due to the gravity of the milk, will again slide downwardly in the bottle as soon as air penetrates into the bottle through the suction openings of the nipple, since the bottom of the bottle is not provided with a one-way-valve but has only an opening. Thus the effect desired by the invention is lost. For the same reason this nursing bottle cannot be used as a comforter dummy, or pacifier, after the milk has been sucked out of the bottle. Another inconvenience is that this nursing bottle, like other known embodiments, has a reduced diameter at the end on which the nipple is mounted. This makes the cleansing of the bottle difficult, which is very important in the use of nursing bottles.

The disadvantages mentioned above have been eliminated by the present invention which is characterized by the use of a nursing bottle in which a negative pressure with the above mentioned results cannot arise in any way, and in which the milk cannot flow out of the bottle if the nipple and bottle is spit out by the baby.

This improvement has been made possible by using as container for the milk a transparent tube, into which a one-way-valve is inserted which is adapted to open at a negative pressure in the bottle but for the rest remains closed, and by the arrangement of a piston between the oneway-valve and the nipple.

With this arrangement the following advantages are attained:

1. Since the milk fills out the total volume between the slidable piston and the top of the suction nipple the baby will not receive any air from the bottle and will be prevented from getting stomach aches.
2. The suction nipple will never be pressed flat by a negative pressure in the bottle thus preventing that the delivery of milk ceases and the baby start crying.
3. Even if the baby spits out the nipple and partially filled bottle the bed will not be soiled with milk.
4. After the milk has been sucked from the bottle it may be used as a comforter dummy, or pacifier, without air penetrating into the stomach.
5. With its small hand the baby can more easily clutch and hold this bottle than a conventional nursing bottle.
6. The bottle is easier to clean than the conventional nursing bottles since all parts thereof may be easily removed from the tube and a round brush may be pushed through the tube.

An embodiment of the invention is shown by way of example in the accompanying drawings in which.

Figures 1, 2, 3, 4, 5, 6:
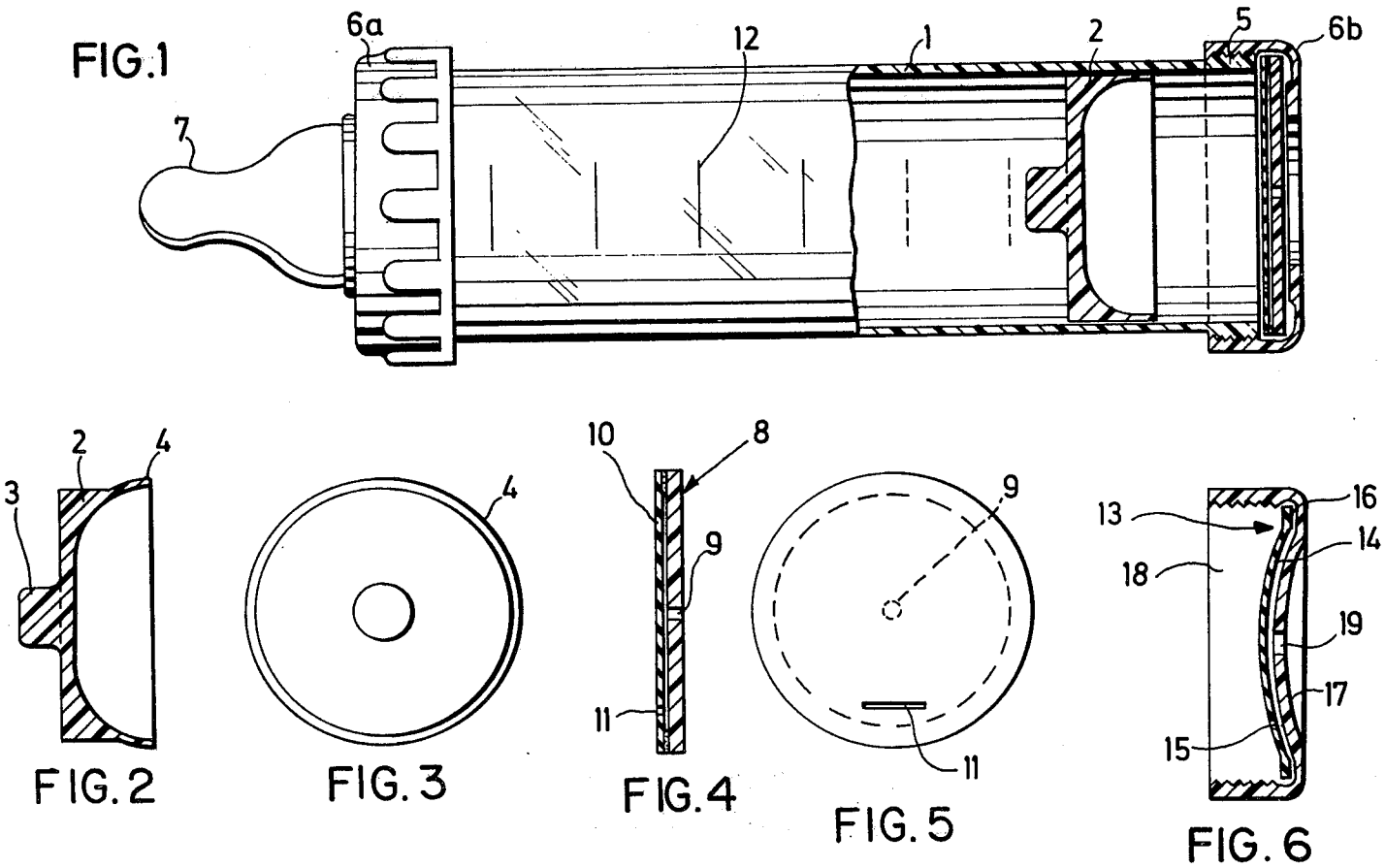
FIG. 1 illustrates the device according to the invention mounted in a tube shown partially in section.
FIG. 2 shows the piston of FIG. 1 in axial section.
FIG. 3 shows the piston of FIG. 2 in plan view.
FIG. 4 shows the one-way valve of FIG. 1 in axial section.
FIG. 5 shows the one-way valve of FIG. 4 in plan view.
FIG. 6 shows a second embodiment of the one-way valve in axial section.

In FIG. 1 of the drawing a piston 2 of elastic material is pushed into a cylindrical tube 1 of a transparent material. On the top side the piston is provided with a boss 3 by means of which it may be pulled out of the tube when it is positioned at the end thereof after the baby has finished the suction. When the piston is positioned within the tube it may be pushed out by blowing air into the tube under the piston. The piston is provided on the underside with a thin-walled skirt 4 whose outer diameter is about 1 mm larger than the inner diameter of the tube. At both ends the tube has a widened diameter 5 provided with threads on which caps 6*a*, 6*b* of conventional type for nursing bottles may be secured. A suction nipple 7 may be secured to one end of the tube over the piston by a threaded cap and at the other end of the tube a one-way valve 8 or 13 of elastic material is secured by a similar cap. The one-way-valve 8 is provided with a valve plate having a central air opening 9. One of the surfaces of the valve plate is covered with a thin foil 10, for instance of guttapercha, which is glued along its periphery to the valve plate but for the remainder it rests loosely thereon. At a suitable distance from the air opening a fine slot 11 is provided through which air is allowed to flow into the tube but is prevented from flowing out in the opposite direction. The tube is provided with a graduation 12 indicating the quantity of milk between the top side of the piston and the top of the nipple. In the one-way-valve 13 the thin foil 14 is made as a separate unit having at least one slot 15 and preferably an annular outer reinforcement 16. In this case the valve plate consists of a domed portion 17 of a cap 18 at which the domed portion is provided with an air opening 19.

The device is used in the following manner: The piston 2 is pushed inwardly to the desired line of the graduation. The tube is graduated from the top downwardly to indicate the total volume of the milk content of the bottle including the volume in the nipple. Milk is refilled and the suction nipple is screwed onto the bottle. The piston is pushed or blown upwardly until the milk fills up the total volume of the suction nipple. Now the one-way-valve 8 and the second cap 6*b* corresponding to the cap for the suction nipple are mounted.

What is claimed is:

1. A nursing bottle, comprising:

a cylindrical tube having a uniform internal diameter, the opposite ends of said tube having external threads formed thereon;

a suction nipple;

a first cap receivable over said suction nipple, and engageable with the external threads on one end of said cylindrical tube for securing said nipple to said one end;

a piston slidably received within said cylindrical tube, and dividing said tube into a first portion facing toward said one end of said tube and adapted to receive liquid to be dispensed through said suction nipple, and a second portion facing toward the other end of said tube;

a thin foil valve element having a diameter greater than the uniform internal diameter of said cylindrical tube, and engageable with the other end of said cylindrical tube;

a valve plate positioned on the outside of said thin foil valve element, said valve plate and said thin foil valve element having non-aligned flow opening means therein arranged to be closed when said thin foil valve element is in engagement with said valve plate; and removable means for detachably connecting said valve plate and said thin foil valve element to said other end of said cylindrical tube.

2. A nursing bottle as recited in claim 1, wherein said removable means and valve plate comprise a second cap having an end wall and an internally threaded cylindrical flange, said flange being threadable on said externally threaded other end of said cylindrical tube, and said end wall forming said valve plate and being integral with said cylindrical flange.

3. A nursing bottle as recited in claim 2, wherein said second cap end wall forming said valve plate includes an inwardly directed domed portion positioned centrally thereof, and of smaller diameter than the uniform internal diameter of said cylindrical tube, said flow opening in said valve plate being located within said domed portion.

4. A nursing bottle as recited in claim 3, wherein said flow opening in said thin foil valve element is located in the portion of said valve element engageable with said domed portion of said valve plate.

5. A nursing bottle, comprising:

a cylindrical tube having a uniform internal diameter, one end of said cylindrical tube having a suction nipple secured thereto, and the other end thereof terminating in a flat, annular end face, and having external threads formed thereon;

a piston slidably received within said cylindrical tube, and dividing said tube into a first portion facing toward said suction nipple and adapted to receive liquid to be dispensed through said suction nipple, and a second portion facing toward the other end of said tube;

a thin foil valve element having a diameter greater than the uniform internal diameter of said cylindrical tube, the outer annular peripheral portion of said valve element being engageable with said flat, annular end face of said cylindrical tube; and a cap member comprising a generally radial end wall formed integrally with an internally threaded cylindrical flange, said flange being threadable on said externally threaded other end of said cylindrical tube, and said end wall including a flat, annular peripheral portion engageable with said outer annular peripheral portion of said valve element to clamp such to said flat, annular end face of said cylindrical tube, and an inwardly directed, central domed portion forming a valve plate engageable by said thin foil valve element, said valve element and said domed portion having non-aligned flow opening means therein arranged to be closed when said thin foil valve element is in engagement with said inwardly directed domed portion.

* * * * *